US005626709A

United States Patent [19]

Keeny

[11] Patent Number: 5,626,709

[45] Date of Patent: May 6, 1997

[54] SINGLE FACER CORRUGATING ROLL FLUTE CONTOUR

[75] Inventor: Thomas R. Keeny, Clementon, N.J.

[73] Assignee: The Langston Corporation, Cherry Hill, N.J.

[21] Appl. No.: 340,098

[22] Filed: Nov. 15, 1994

[30] Foreign Application Priority Data

Nov. 20, 1993 [GB] United Kingdom ..... 9323946

[51] Int. Cl.[6] ..... B31F 1/26; B31F 1/28

[52] U.S. Cl. ..... 156/472; 156/205; 156/210; 493/463

[58] Field of Search ..... 156/472, 471, 156/205, 210, 553; 493/463; 492/36

[56] References Cited

U.S. PATENT DOCUMENTS

| | | |
|---|---|---|
| 50,802 | 11/1865 | Danner . |
| 1,936,228 | 11/1933 | Crafton . |
| 2,241,146 | 5/1941 | Little . |
| 2,258,443 | 10/1941 | Bruker . |
| 2,343,126 | 2/1944 | Matlat . |
| 3,053,309 | 9/1962 | Wilson et al. . |
| 4,101,367 | 7/1978 | Maier . |
| 4,503,696 | 3/1985 | Roeder . |

FOREIGN PATENT DOCUMENTS

| | | |
|---|---|---|
| 98936 | 1/1984 | European Pat. Off. . |

*Primary Examiner*—Adrienne C. Johnstone
*Attorney, Agent, or Firm*—Seidel, Gonda, Lavorgna & Monaco, PC

[57] ABSTRACT

A single facer has corrugating rolls of which the cross-sectional tip and root curves are elliptical (as broadly defined) to form a medium compression zone 38 beyond which, on each side of the tip center line, the root extends to define a clearance gap greater than the thickness of the medium; the root curve may (FIGS. 2 and 3) continue as an ellipse which also defines the flute flank, or alternatively the flute flank may be defined by a straight line 76 (FIG. 4) with a transition curve 58 between the straight line and the root curve 52. According to a different aspect of this invention, flank clearance is provided by the use of differently shaped flutes on the two corrugating rolls; for example (FIG. 5) the second roll 71 which carries the medium after corrugating may have straight flanks 76, and the other roll may have concave flanks 78.

11 Claims, 3 Drawing Sheets

FIG. 1
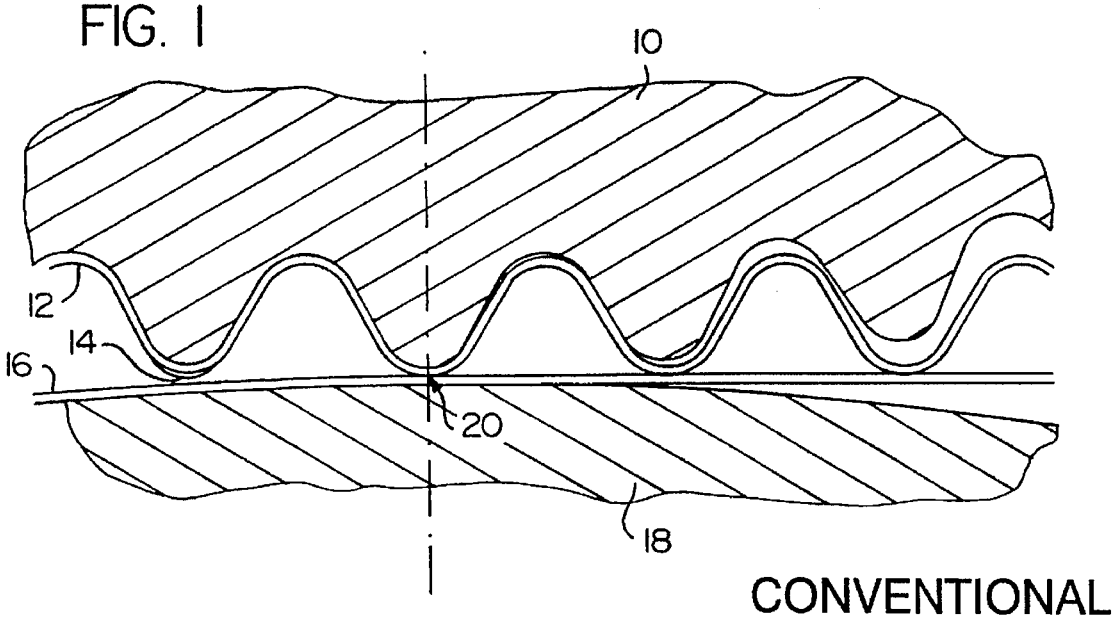
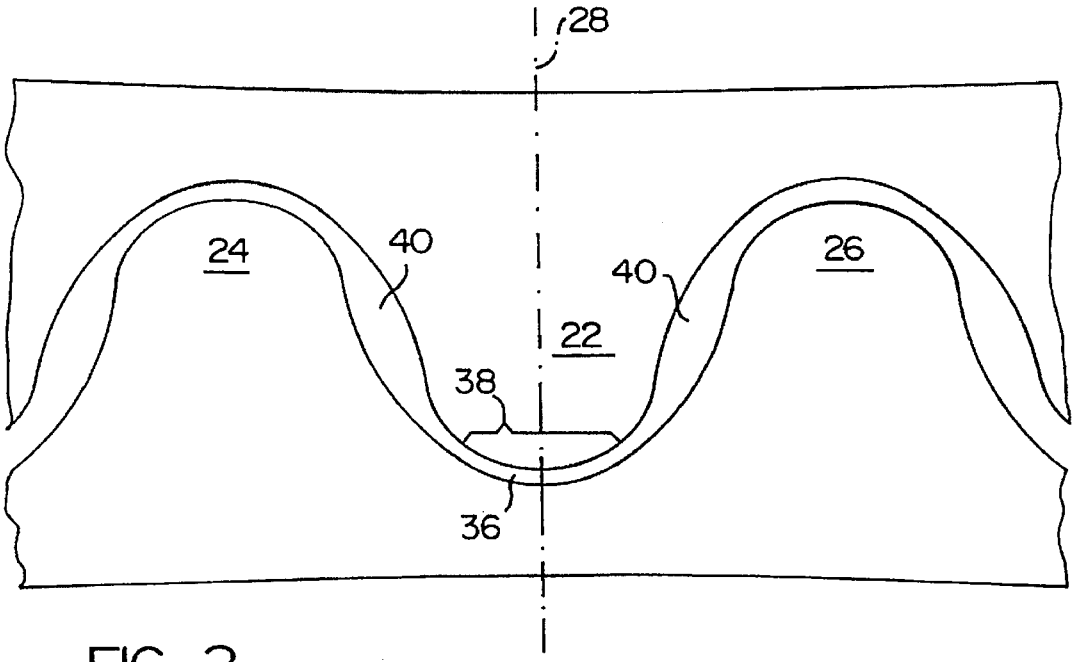
FIG. 2

SINGLE FACER CORRUGATING ROLL FLUTE CONTOUR

Corrugated board is commonly manufactured by passing a web of corrugating material between corrugating rolls to form transversely extending corrugations in the medium, which then has adhesive applied to the tips of the corrugations on one side in order to join the medium to a continuous liner which is applied and pressed firmly against the medium, normally by a pressure roll. The machine carrying out this part of the process is commonly referred to as a "single facer machine". In a subsequent part of the process, a second liner is applied to the other side of the corrugating medium to form a continuous board which is then cut into individual sections used commonly for box making.

The corrugating rolls usually have identically contoured parallel flutes forming ribs which inter-engage and press the transverse corrugations into the corrugating medium. The tips of the ribs are commonly part-circular in cross-section, and the roots (the bottoms of the flutes) are likewise part-circular in cross-section but with a larger radius, the difference in the radii being approximately equal to the thickness of the corrugating medium. One of the corrugating rolls is usually externally driven and it drives the other roll by virtue of engagement of the tips and roots of the corrugations formed in the two rolls.

It is desirable to prevent flank-to-flank contact between the corrugations of the two rolls or, more specifically, compression of the corrugating medium between the flanks. This is commonly achieved by suitable choice of the radii of the tips and roots of the corrugating rolls, for example as described in U.S. Pat. No. 4,101,367 with reference to FIG. 4. In regard to the achievement of flank-to-flank clearance reference is also directed to U.S. Pat. No. 3,053,309 and to European patent No. 98936.

In order to attain a virtually instantaneous partial bond between the liner and the corrugating medium sufficient to enable the liner to carry the medium forward from the cooperating corrugating roll, it is necessary for the pressure roll to apply the liner to the corrugating medium with significant force. This can result in weakening of the liner and in some instances even in cutting of the liner because of the usually small radius of the tip curve of the corresponding corrugating roll.

SUMMARY OF THE INVENTION

The present invention is mainly concerned with a flute contour for the corrugating rolls which reduces the risk of damage to the liner while satisfying other desirable criteria involved in the corrugating process.

According to one aspect of this invention, the tip and root curves of the corrugating rolls are elliptical in shape (as defined below); the tip and root curves differ so that, when their center lines are aligned, they define a gap of approximately uniform thickness extending for a predetermined distance in both directions from the center line, along what will be referred to herein as the "medium compression zone", and the root contour extends beyond the predetermined distance, on each side of the center line, as a curve which extends to a flank contour spaced from the opposed flank of the cooperating flute by a distance greater than the thickness of the above-mentioned gap along substantially the entire length of the flank.

In this context the term "elliptical" refers broadly to a curve having a relatively large radius at the center line (corresponding to the center line of the tip) and a reduced radius of curvature on each side of the center line leading to the flank of the rib. A true mathematical ellipse is one preferred example, but the term "ellipse" in this context also encompasses, for example, a curve comprising a relatively large fixed-radius curve extending in both directions from the center line of the tip along at least part of the medium compression zone, changing progressively (or possibly in one or more stages) to a smaller radius curve extending smoothly to the flank contour, which may be substantially straight. This example represents the simplest form of curve encompassed by the term "elliptical" in this context, in contrast with which a true mathematical ellipse has an ever-changing radius of curvature.

According to another aspect of this invention, a corrugating machine comprises first and second cooperating fluted rolls for forming transversely extending corrugations in a continuous web of corrugating medium which, after becoming corrugated, is carried by one of the rolls (referred to herein for convenience as the second of the rolls), and including means for applying adhesive to the tips of the corrugated medium and means for pressing onto the medium a liner which carries the adhering medium from the second roll, characterized in that the flutes of the second roll have substantially straight flanks, the flanks of the ribs formed by the flutes of the first roll being concave or otherwise recessed so as to provide flank-to-flank clearance as between the two rolls.

Further objects, features and advantages of the present invention will become more apparent to those skilled in the art as the nature of the invention is better understood from the accompany drawings and detailed descriptions.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is a cross-section showing a conventionally corrugated medium having a liner applied to it by a pressure roll;

FIG. 2 is an enlarged cross-section showing the flute contours of one machine according to the first aspect of this invention;

DETAILED DESCRIPTION OF THE INVENTION

Figure 3:
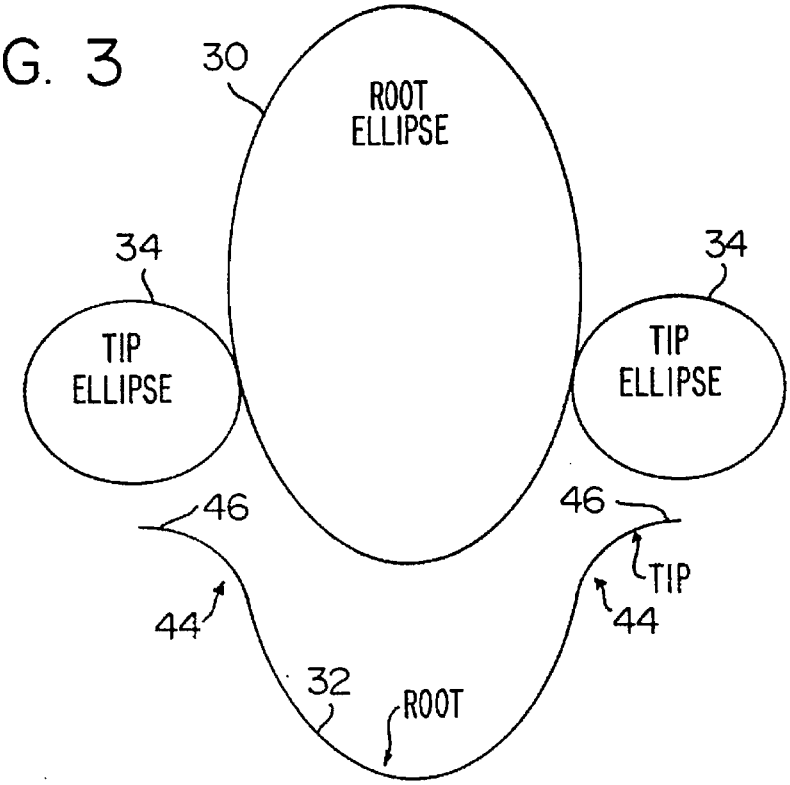
FIG. 3 shows mathematical ellipses (at a scale slightly different from FIG. 2) defining the tip and root contours of the flutes shown in FIG. 2.

FIG. 1 shows a conventionally contoured corrugating roll 10 carrying a corrugated medium 12 to which adhesive 14 has been applied to the tips of the corrugations on one side. A liner 16 is carried by a pressure roll 18 which presses the liner firmly against the medium at an application point 20, Beyond this point, the liner 16 proceeds in a straight direction towards a further conveying roll (not shown) and carries the corrugated medium 12 with it.

FIG. 2 shows one complete rib 22 of one corrugating roll engaging between two ribs 24 and 26 of the second corrugating roll. The point of engagement shown in FIG. 2 corresponds with the maximum penetration of the rib 22 into the flute between the ribs 24 and 26; the axes of the two rolls lie on the center line 28.

The tip and root curves are both parts of true mathematical ellipses and are illustrated by FIG. 3. The ellipse 30, in the region of the end of its major axis, defines the root contour 32. The tip contours 46 are defined by smaller ellipses 34 in the regions lying at the ends of the minor axes of those ellipses.

The shapes of these ellipses are such that, as shown in FIG. 2, they define a gap 36 of approximately uniform thickness, along a medium compression zone 38, corresponding to the thickness of the corrugating medium. Beyond this zone the gap increases to provide clearance spaces 40 between the flanks of the ribs which are significantly thicker than the gap 36.

In this example, each rib flank is defined substantially entirely by a continuation of the elliptical curve forming the root. Thus, each flank contour would have a concave or elliptical shape. Also, as shown in FIG. 3, the root/flank elliptical curve merges smoothly at positions 44 with the elliptical curves defining the contours of the tips 46 of the adjacent ribs.

The radius of curvature of each tip at its center line is greater than would be practicable if the tip were defined by a fixed-radius curve as shown in FIG. 1. In normal circumstances the maximum radius of a fixed-radius tip is defined by the following formula:

$$T \leqq \frac{4D^2 + P^2}{16D} - \frac{M}{2}$$

Where:

T=Tip radius of flute profile

D=Depth of flute profile

P=Pitch of flute profile

M=Thickness of corrugating medium

Use of elliptical flutes in accordance with this invention enables the tip curvature at the center line to be larger than normal maximum defined by the above formula. This therefore reduces the concentration of pressure and the resulting proneness to damage to the liner and medium created by the force which needs to be applied by the pressure roll, which is typically at least 150 pounds per lineal inch of medium width (173 kg/cm).

Figure 4:
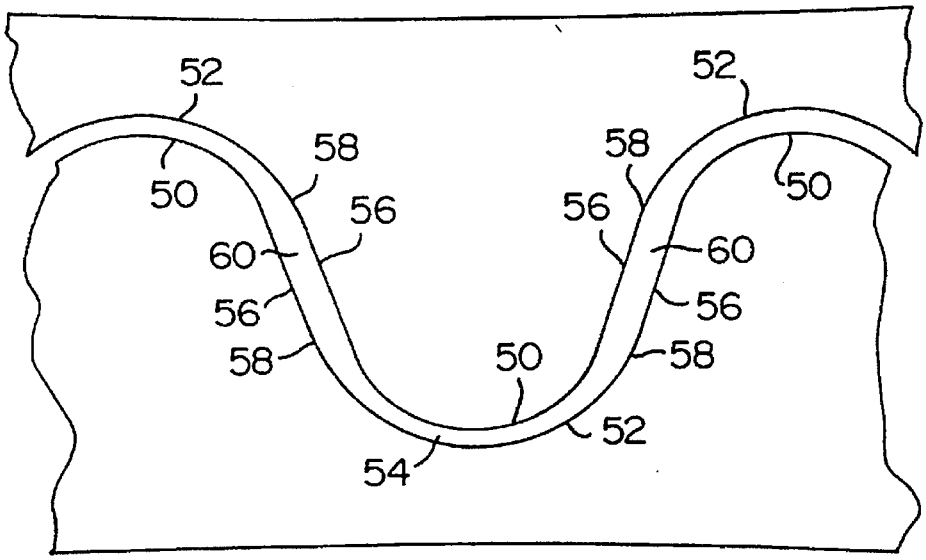
FIG. 4 shows an alternative flute contour according to the first aspect of this invention.

FIG. 4 shows an alternative arrangement. In this example, as in the example shown in FIGS. 2 and 3, tip and root contours 50 and 52 are both elliptical so as again to define a gap 54 of approximately uniform thickness corresponding to the thickness of the corrugating medium in the medium compression zone. The flanks are formed mainly as straight lines 56. Each straight line is tangential to the elliptical tip curve at the tip end, and at the other end is tangential to a short transitional curve 58 which departs slightly but smoothly from the elliptical shape of the root contour. This again defined flank clearance gaps 60 which are significantly greater than the thickness of the gap 54.

As well as reducing the concentration of pressure between the pressure roll and the corresponding corrugating roll, by virtue of the larger-radius curve at the center line of each rib, the present invention is also beneficial in that the larger surface area of the tips, by virtue of the elliptical shape, reduces the rate at which the tips wear away during use. Thus corrugating rolls according to this invention can be used for a longer period before wear necessitates regrinding of the rolls.

It is acknowledged that the above-mentioned U.S. Pat. No. 4,101,367 suggests, in column 9, the possibility of a non-circular tip contour and specifically mentions an elliptical shape as one possibility.

Figure 5:
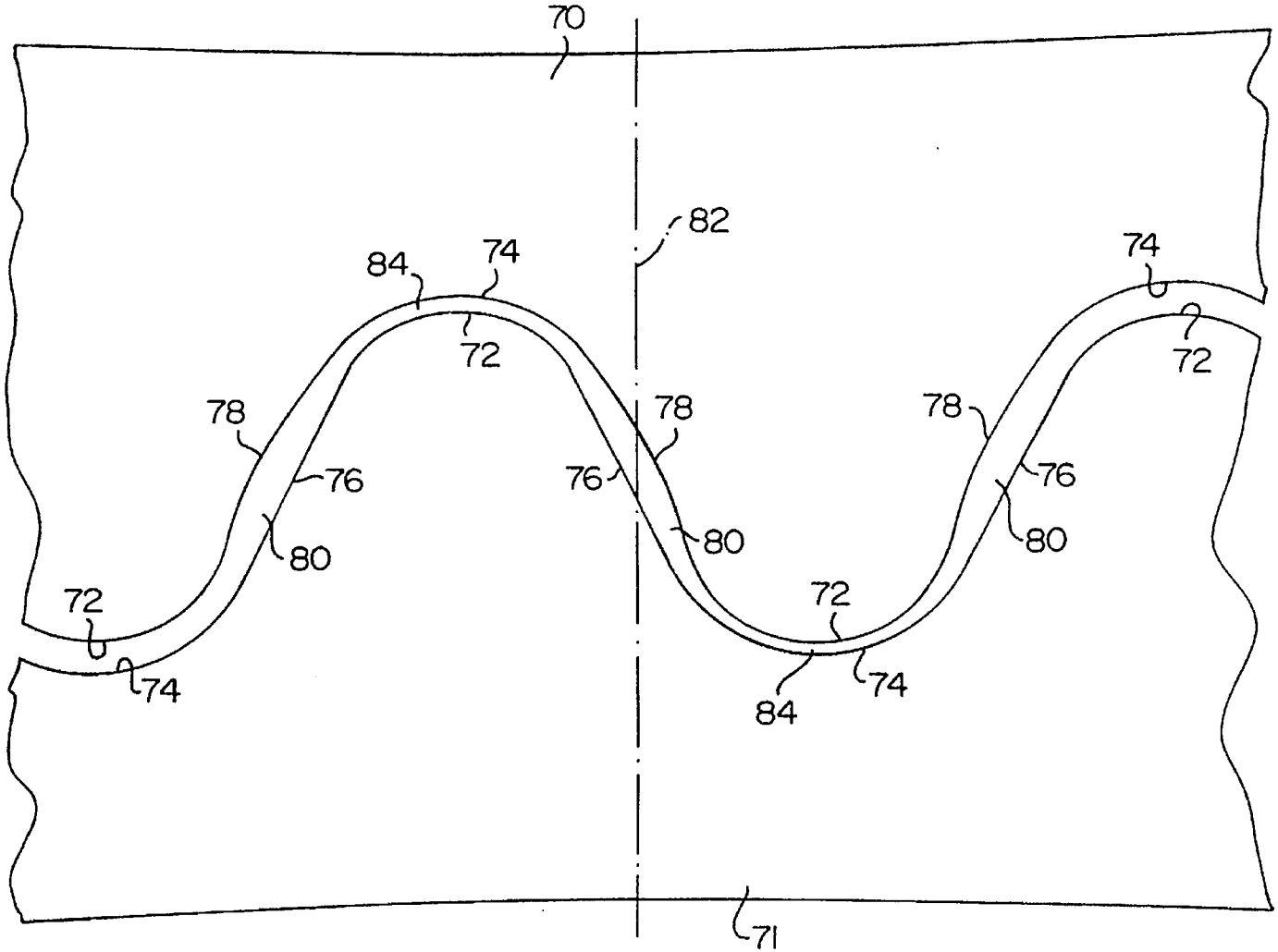
FIG. 5 shows flute contours according to the second aspect of this invention.

FIG. 5 is an example according to the second aspect of this invention. In this example, first and second rolls 70 and 71 have different flute contours. Each roll has fixed-radius tips 72 and fixed radius roots 74, the difference between these radii being equal to the nominal thickness of the corrugating medium, which is commonly about 0.009 inch (0.23 mm) but may generally be within the range 0.006–0.013 inch (0.15–0.33 mm).

The rolls differ in that the second roll 71 (which corresponds to the roll 10 in FIG. 1 in that it carries the medium after it has become corrugated) has flanks 76 defined by straight lines tangential to the tip and root curves, while the first roll 70 has concave (radiused) flanks having smooth transitions to its corresponding tip and root curves. This results in flank clearance gaps 80 which ensure that the medium is never compressed by the flanks.

FIG. 5 shows the rolls at a stage at which one tip of the roll 70 and an adjacent tip of the roll 71 lie on opposite sides of a center line 82 of the rolls, equidistant from the center line. Accordingly, each of the tips at this stage is acting to compress and shape the medium in cooperation with the corresponding root; the centers of curvature of each pair of cooperating tip and root curves coincide and each of the tip-to-root gaps 84 is equal to the difference between the tip and root radii.

Thus the gap between tip and root in substantially the entire medium compression zone in each case is of uniform thickness. This thickness (the radius difference) may, as already mentioned, be equal to the thickness of the corrugated medium; that is to say, the thickness before compression. Alternatively, the radius difference may be smaller, approaching or even equalling the thickness of the medium when compressed by the cooperating tips and root contours. The same may apply to the gaps in the examples shown in FIGS. 2 to 4 or to the average gap thickness since that (measured in directions normal to the tip or root surface) is not necessarily precisely uniform.

Instead of the tip and root contours in FIG. 5 being fixed-radius curves, they may be elliptical, either in the true mathematical sense or in the more general sense described above.

Instead of the non-identical flutes of the rolls 70 and 71 shown in FIG. 5 being respectively concave and straight in cross-section, the required flank clearance can be achieved, for example, by making the flanks of the roll 70 more deeply concave and the flanks of the roll 71 could then be slightly convex in cross-section. Alternatively, the flanks of the roll 71 may be slightly concave and the flanks of the roll 70 may be more deeply concave but less than is needed with straight flanks on the roll 71.

The present invention may be embodied in other specific forms without departing from the spirit or essential attributes thereof and, accordingly, reference should be made to the appended claims, rather than to the foregoing specification, as indicating the scope of the invention.

I claim:

1. A single facer corrugating machine, the improvement comprising two cooperating fluted corrugating rolls of which the flute tip and root curves have a relatively large radius at the center line and a reduced radius on each side of the center line leading to the flanks between the tip and root curves, the tip and root curves differing so that, when their center lines are aligned, they define a gap of approximately uniform thickness extending for a predetermined distance in both directions from the center line, the root contour extending beyond that predetermined distance, on each side of the center line, as a curve which extends to a flank contour spaced from the opposed flank of the cooperating flute by a distance greater than the thickness of the gap along substantially the entire length of the flank, the flank contours on at least one of the corrugating rolls being concave.

2. A single facer corrugating machine as in claim 1 wherein the flank contours on both of the corrugating rolls are concave.

3. A single facer corrugating machine as in claim 1 wherein the flank contours on both of the corrugating rolls are elliptical.

4. A single facer corrugating machine as in claim 1 wherein the flank contours on one of the corrugating rolls are concave and the flank contours on the other corrugating roll are straight.

5. A single facer corrugating machine as in claim 4 wherein the concave flank contours are elliptical.

6. A single facer corrugating machine as in claim 1 wherein each tip contour is defined by an ellipse with a minor axis of the ellipse aligned with a radial line extending through a center of rotation of the corrugating roll and the center line of the tip.

7. A single facer corrugating machine as in claim 1 wherein each root contour is defined by an ellipse with a major axis of the ellipse aligned with a radial line extending through a center of rotation of the corrugating roll and the center line of the root.

8. A single facer corrugating machine as in claim 1 wherein the root contours are defined by an ellipse with a minor axis of the ellipse aligned with a radial line extending through a center of rotation of the corrugating roll and the center line of the root.

9. A single facer corrugating machine as in claim 1 wherein the instantaneous radius of curvature of the tip at the center of each flute on the corrugating rolls is greater than $$\frac{4D^2+P^2}{16D}-\frac{M}{2}$$

wherein D is the flute profile depth, P is the flute profile pitch, and M is the intended corrugating medium thickness.

10. A single facer corrugating machine as in claim 1 wherein each tip contour is defined by an ellipse with a minor axis of the ellipse aligned with a radial line extending through a center of rotation of the corrugating roll and a center line of the tip and each root contour is defined by a second ellipse with a major axis of the second ellipse aligned with a radial line extending through the center of rotation of the corrugating roll and the center line of the root.

11. A single facer corrugating machine as in claim 1 wherein each tip contour is defined by an ellipse with a minor axis of the ellipse aligned with a radial line extending through a center of rotation of the corrugating roll and a center line of the tip and each root contour is defined by a second ellipse with the minor axis of the second ellipse aligned with a radial line extending through the center of rotation of the corrugating roll and the center line of the root.

* * * * *